United States Patent [19]

Bolognino

[11] 4,412,391

[45] Nov. 1, 1983

[54] WATER HEATER UTILIZING LAUNDRY DRYER EXHAUST

[76] Inventor: John V. Bolognino, 24836 Masch, Warren, Mich. 48091

[21] Appl. No.: 427,458

[22] Filed: Sep. 29, 1982

[51] Int. Cl.[3] ..... F26B 19/00

[52] U.S. Cl. ..... 34/90; 34/86; 122/20 B

[58] Field of Search ..... 122/20 A, 20 B, 7 R; 34/86, 90

[56] References Cited

U.S. PATENT DOCUMENTS

| | | | |
|---|---|---|---|
| 1,633,759 | 6/1927 | Breese, Jr. . | |
| 1,716,921 | 6/1929 | Guenther . | |
| 2,189,749 | 2/1940 | Windheim et al. . | |
| 2,604,880 | 7/1952 | Stanley . | |
| 3,050,867 | 8/1962 | Friedman . | |
| 3,673,701 | 7/1972 | Albertson | 34/90 |
| 4,048,962 | 9/1977 | Pristelski . | |
| 4,161,214 | 7/1979 | Wendel . | |
| 4,210,102 | 7/1980 | Dosmann . | |
| 4,275,510 | 6/1981 | George . | |

*Primary Examiner*—Edward G. Favors

*Attorney, Agent, or Firm*—Harness, Dickey & Pierce

[57] ABSTRACT

A water preheating system extracts heat energy from the exhaust gases of a laundry dryer. The hot exhaust gases are introduced into a heating chamber where they are directed at the underside of a water storage tank used to furnish preheated water to a conventional hot water heater. A condensation collection and disposal system collects condensation for re-evaporation or drainage.

13 Claims, 5 Drawing Figures

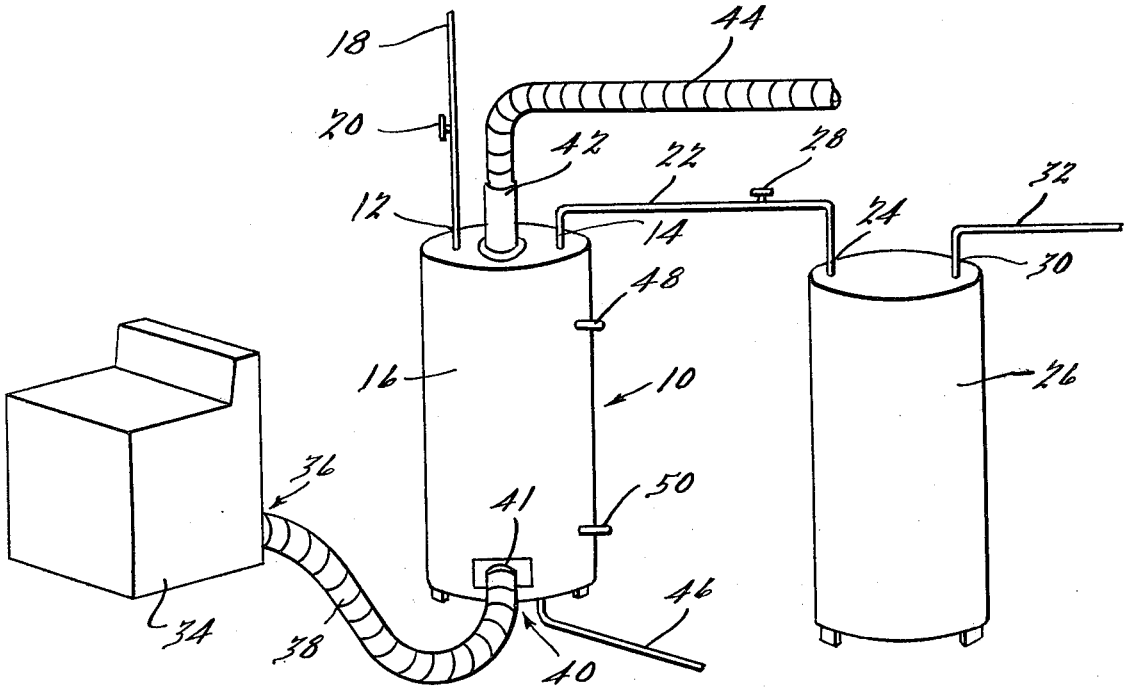
Fig. 1.
Fig. 2.
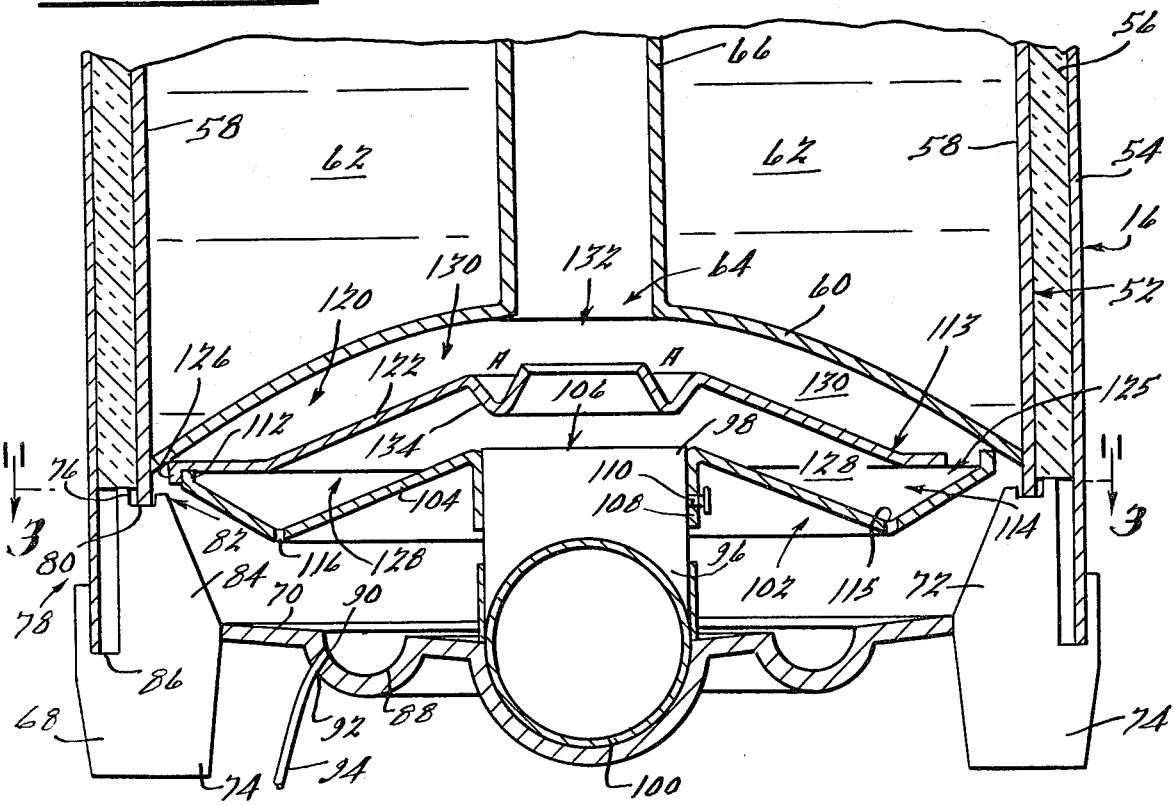

WATER HEATER UTILIZING LAUNDRY DRYER EXHAUST

BACKGROUND OF THE INVENTION

1. Field of the Invention

This invention pertains to water preheating systems, and in particular to a water preheating system utilizing the exhaust gases from a laundry dryer to preheat and store water for delivery upon demand to a conventional hot water heater.

2. Description of the Prior Art

It is well known that much heat energy is wasted by venting the hot exhaust gases of a laundry dryer directly into the atmosphere. With heating costs rising year after year it is recognized that what was once unwanted waste heat must now be put to better use.

In the commercial setting of a laundry or laundromat, there have been proposed complex schemes for recovering some of the heat energy of laundry dryer exhaust which would otherwise be lost. These schemes often employ relatively complex and expensive devices which become practical only under the economy of scale. Such devices include those disclosed in U.S. Pat. Nos. 3,050,867 to Friedman, issued Aug. 28, 1962; 4,161,214 to Wendel, issued July 17, 1979; and 4,275,510 to George, issued June 30, 1981. All of these systems are designed to work with a plurality of individual dryers. Common to each of the systems is a closed loop, pumped fluid heat removal circuit, employing individual heat exchangers disposed on or within the existing laundry dryer exhaust vents.

Because of their relative complexity and cost the heat removal systems of the prior art are unworkable in the average household laundry. In the household environment the cost of the heat recovery equipment must be kept to a minimum so that the system will "pay for itself" after only a few number of years. To keep costs to a minimum a heat recovery system for household use should be compatible with the homes existing plumbing. In addition, it is highly desirable that such a system be economically manufactured, preferably so as to be incorporated into a water heater manufacturer's line of products without the need to make drastic changes in existing manufacturing equiment and tooling. This invention will adapt to the bottom of existing hot water tanks now in production with only a slight modification.

Such a device would fill a growing need for home energy conservation products and would save countless dollars in wasted fuel now escaping through exhaust vents across the country.

SUMMARY OF THE INVENTION

The present invention provides a water preheating system for use with a laundry dryer of the type which vents or exhausts heated air. The invention is adapted to provide a source of preheated water which is in turn deliverable to a conventional hot water system upon demand through the conventional heater's water inlet pipe. The invention comprises a water storage tank supported on a base, and includes an air intake port which may be coupled to receive heated air from the laundry dryer vent through a section of conventional flexible dryer venting hose. The invention further includes an air retainer device coupled to the intake port which serves to direct heated air from the intake port generally towards the underside of the tank. The air retainer is adjustably positionable against the underside of the tank so as to define a heating chamber therebetween. An exhaust flue disposed generally axially within the interior of the tank communicates with the heating chamber for attachment to the household's existing dryer exhaust port or vent. Being disposed on the interior of the tank, the exhaust gases escaping through the flue give up additional heat to the water stored within the tank. The invention further comprises a condensation collection system in the form of channel or well disposed on the base generally beneath the underside of the tank and has a drain orifice therein for collecting and removing condensation from within the heating chamber. The invention also includes an air deflection or baffle system disposed within the heating chamber which serves to direct heated air radially along the underside of the tank. The air deflection system preferably includes a restricted orifice for creating low pressure zones within the heating chamber, serving to increase air flow along the underside of the tank. The water preheating system includes water inlet and outlet orifices which are adapted to receive water from a supply main, for storage and heating within the tank, and to supply preheated water to the conventional hot water heating system. It will be also understood that the water entering the preheat tank in winter time will be tempered by the ambient room temperature.

BRIEF DESCRIPTION OF THE DRAWINGS

FIG. 1 is an elevational view of the water preheating system shown in conjunction with a conventional laundry dryer and conventional hot water tank heater to illustrate the operational relationship of the system;

FIG. 2 is a sectional view of the invention;

DESCRIPTION OF THE PREFERRED EMBODIMENT

Figure 3:
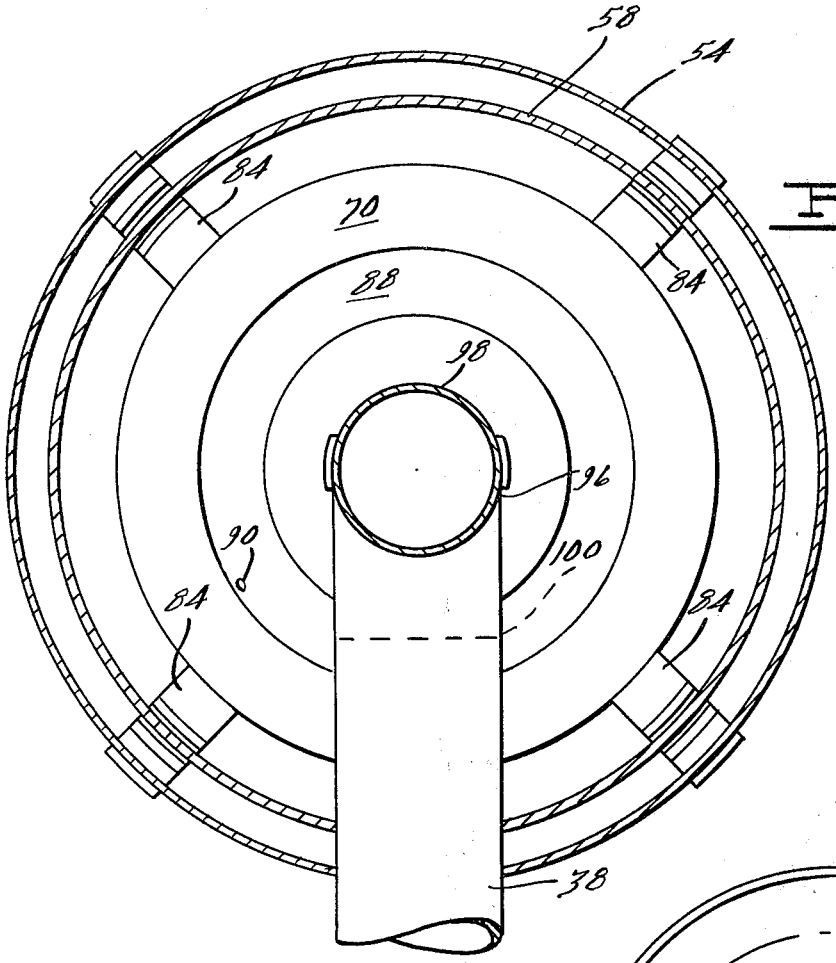
FIG. 3 is a sectional view taken along the line 3—3 of FIG. 2 of the invention.

Referring to FIG. 1 the water preheating apparatus of theinvention is illustrated in conjunction with a conventional home laundry system. It will of course be recognized that while the invention is quite useful and beneficial in the home setting, it is equally useful and beneficial in a commercial setting, such as in a commercial laundry or laundromat. It will be understood that the following description sets forth the presently preferred embodiment of the invention suitable for domestic applications and readily modified by those skilled in the art to meet the needs of commercial users.

The preheating apparatus, denoted generally by reference numeral 10, has a water inlet 12 and outlet 14 for communicating water into and out of a storage and heating tank 16. The water inlet 12 is adapted to be coupled to a source of water to be preheated, such as from a cold water supply main via inlet pipe 18. Inlet pipe 18 may include a shut-off valve 20 according to the usual practice. The water outlet 14 is adapted to be coupled via connecting pipe 22 to the water inlet 24 of a conventional hot water heater 26. Connecting pipe 22 may include a shut-off valve 28 according to the usual practice. The hot water heater 26 has the usual water outlet 30 for delivering hot water via pipe 32 to the user upon demand.

Heat energy for preheating the water contained within tank 16 is derived from the exhaust heat of a conventional laundry dryer 34. The laundry dryer exhaust is expelled from the dryer's exhaust vent or port 36, which port is coupled through a section of flexible hose 38 to the air intake port 40 of the invention. If desired a lint trap, such as a screen 41, may be inserted in the intake port 40 to intercept airborne lint particles. After heat energy of the dryer exhaust is transmitted to the water within tank 16, the exhaust is then vented through a flue system, to be described more fully below, and out through chimney 42. The chimney 42 is adapted to be coupled via a length of flexible hose 44 to a conventional vent or opening to the atmosphere. The invention also includes a water outlet hose 46 which is coupled to a condensation draining system to be discussed more fully below. The water preheating tank 16 may also include an additional water inlet port 48 and water outlet port 50 for connection to an optional circulated fluid solar heating panel or other types of circulating heating pick-up units.

Referring now to FIG. 2, the water preheating apparatus 10 will be described in more detail. FIG. 2 illustrates the lower portion of the invention in cross section. The water preheating and storage tank 16 comprises a generally cylindrically shaped containment vessel 52 surrounded by a concentric cylindrical shell or jacket 54. The jacket 54 is preferably of a larger diameter than the containment vessel 52 so as to define an annular insulation space 56 between the vessel 52 and the jacket. This insulation space may be air filled or packed with insulative material such as fiber glass or foam. The quantity of insulation within the annular space 56 is largely determined by the temperature of the incoming water through pipe 18, the ambient air temperature surrounding the tank 16, and the heat energy produced by the dryer 34. In some applications, especially where the ambient air temperature surrounding the tank is warmer than the preheated water within containment vessel 52, it may prove desirable to minimize the insulation between containment vessel 52 and the outer shell or jacket 54 so as to permit the water stored within the vessel to extract additional heat energy from the ambient air and surrounding environment. In this regard, the bottom half of the tank's insulation may be removed so that more pick-up heat is available along the sides and cold water (38 degrees) can be tempered quicker.

The containment vessel 52 has outer cylindrical sidewalls 58 and a bottom wall or underside 60 defining a water storage chamber 62. The underside 60 is preferably slightly bell-shaped or dome-shaped and has a generally radially centered opening 64 therein which communicates with an upstanding flue 66. The flue 66 is axially disposed within the containment tank and communicates with chimney 42. It will be seen that flue 66, by virtue of its thermal contact with the water within containment vessel 52, enhances the heat extraction process.

The invention further comprises a pan or base 68, which may be economically fabricated of plastic by an injection molding process or a sheet metal stamping, for example. The base 68 is generally circular and conforms to the dimensions of tank 16. The base 68 comprises a basin portion 70 disposed generally beneath the underside 60 of containment vessel 52 and having axially upstanding sidewalls 72 around its outer periphery. The basin 70 may be supported above the ground by a foot portion 74 integrally formed therein. In the preferred embodiment the base is adapted to support tank 16, and towards this end the base is provided with an upstanding means 76 for supporting the containment vessel 58 and a second means 78 for supporting the outer tank shell or jacket 54. Supporting means 76 may comprise an annular upwardly presenting channel 80 formed along the upper lip 82 of sidewall 72. Alternatively, supporting means 76 might comprise an upwardly presenting groove or notch 80 formed in a plurality of pilasters 84 which project partially from the sidewall 72 of base 68. As shown in FIG. 2 supporting means 78 may comprise an annular channel 86 formed in sidewalls 72 and adapted to receive the outer shell or jacket 54.

The base 68 further includes a condensation collection system which comprises an annular trough or well 88 depending from basin 70 and so constructed and arranged to collect any condensation which may accumulate within the basin. Preferably well 88 may be integrally formed in the base, as during the injection molding process or formed in a sheet metal part. Well 88 also includes a drain orifice 90 which is equipped with a fitting 92 for connection of a plastic or rubber drain hose 94 thereto. The drain 90 with drain hose 94 attached thus permits any collected condensation within well 88 to be disposed of.

With reference to FIG. 3 and continued reference to FIG. 2 the invention further comprises a generally L-shaped conduit 96 having an upwardly presenting distal end portion 98 in axial alignment generally with the flue 66. Conduit 96 also has a proximal end portion 100 extending generally radially outward from the axis of the tank 16 and being adapted to connect with flexible dryer pipe 38. It will be appreciated that the connection between dryer hose 38 and the proximal end portion 100 may be made either within the interior of base 68, as shown in FIG. 3, or at the exterior of the base, as shown in FIG. 1. In either case the L-shaped conduit serves to receive heated air introduced through the air intake port 40 and to direct that air generally towards the underside 60 of tank 16.

Figure 4:
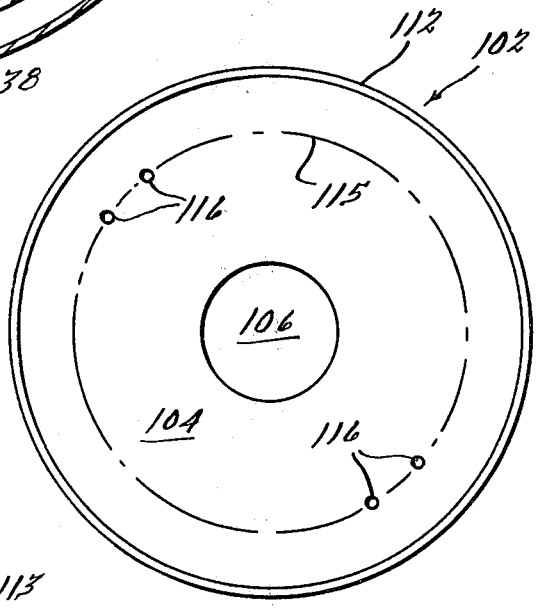
FIG. 4 is a plan view of the heat retainer of the invention.

To facilitate directing heated air along underside 16 and to maximize the exchange of heat energy through underside 60 an air retainer means 102 is provided. The air retainer means, shown in FIGS. 2 and 4, comprise a generally circular dish 104 having a centrally located passageway 106 therein. Passageway 106 includes an axially downturned flange 108 which is adapted for mating engagement with the distal end portion 98 of L-shaped conduit 96. Flange 108 is slidably carried on conduit 96 permitting it to be axially positioned upwardly or downwardly, for reasons yet to be explained. Flange 108 is also provided with one or more set screws 110, or the like, for securing flange 108 to conduit 96 once proper axial adjustment has been made.

Dish 104 is thus disposed generally beneath the underside 60 of the tank and has an axially upturned flange 112 around its outer periphery. The peripheral flange 112 is adapted to be positioned (by sliding flange 108 either upwardly or downwardly on conduit 96) so as to bring flange 112 into abutting relationship with the underside 60 of the tank. The dish 104 together with underside 60 thus forms or defines a heating chamber 114. To facilitate collection and removal of condensation the dish 104 includes an annular gutter 115 having a plurality of perforations 116 to allow condensation to drip through gutter 115 into the basin 70.

Figure 5:
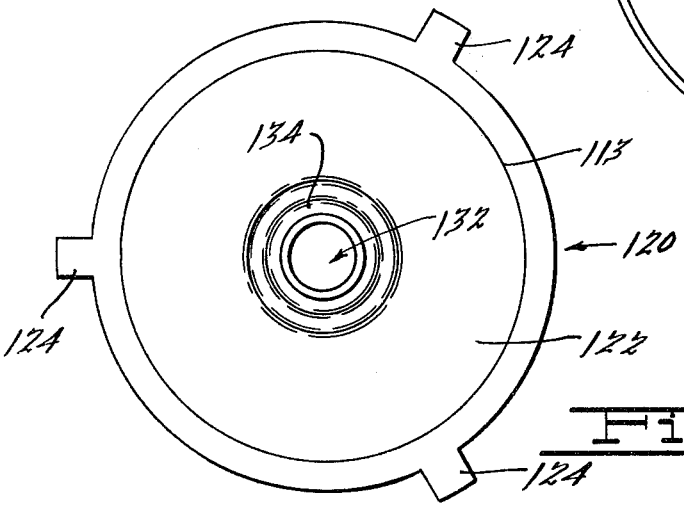
FIG. 5 is a plan view of the baffle plate of the invention.

To further enhance heat transfer an air deflection system 120 is provided. The air deflection system 120, shown in FIGS. 2 and 5, preferably takes the form of a circular baffle plate 122 carried on the peripheral flange 112 of dish 104 by means of a plurality of tabs or ears 124. The baffle plate is preferably formed with a slight concavity as at 113 and the tabs or ears include downturned flange portions 126 which serve to secure the baffle plate to the dish. Baffle plate 122 is thus disposed generally within heating chamber 114 between underside 60 and dish 104 to divide the heating chamber 114 into a first space 128 generally adjacent dish 104 and a second space 130 generally adjacent the underside 60. Baffle plate 122 includes a restricted orifice 132 disposed generally in axial alignment with the distal end 98 of the conduit 96. Preferably the portion of baffle 122 around the restricted orifice 132 is formed with an annular fold or corrugation 134, defining an air space above the corrugation noted by reference letter A in FIG. 2. The restricted orifice 132 thus serves to relieve back pressures within heating chamber 114 and also creates a low pressure area in the region denoted by A. The baffle plate 122 is generally of a smaller diameter than the diameter of dish 104. Because the baffle plate is carried on dish 104 by means of a plurality of tabs 124 there remains an annular air space or opening 125 around the outer periphery of the baffle plate to permit heated air to communicate between space 128 and space 130.

In operation, heated air from the exhaust dryer vent is coupled through hose 34 and intake port 40, where some of it is then forced through restricted orifice 132. As a consequence of being forced through the restricted orifice, a low pressure region or zone is set up around corrugation 134, as at A. This low pressure zone pulls additional hot air around the air deflector as shown by the arrows. In this fashion heated air is caused to flow radially outwardly within space 128, up through the annular opening 125 between dish 104 and baffle 122, and vents radially inwardly along the underside 60 of the tank and out through flue 66. The air deflection system thus described results in very little, if any, undersirable back pressure which would otherwise inhibit normal operation of the dryer 34. Furthermore, the air deflection system quite beneficially directs the heated air over substantially the entire underside of the tank for maximizing heat absorption by the water within the tank. Also, as stated earlier, the flue 66 by being located within the interior of the tank in thermal contact with the water, further improves heat transfer.

Any condensation which might form when the heated (often moist) air from dryer 34 meets the cool underside 60 of the tank either drips onto baffle plate 122, or follows the dome-shaped contour of underside 60 and runs into air retainer 102 where it can momentarily collect in gutter 115. Due to the slightly concave nature of baffle 122, a certain quantity of condensation can collect on the upward surface of the baffle where it may evaporate and exit through the flue. If the quantity of condensation collected on the upper surface of baffle 122 overflows the shallow concavity of the baffle it will then drip into the air retainer 102 and collect in gutter 115. Any condensation in gutter 115 will either evaporate and exit through the flue or drain through perforations 116 and collect in well 88. Condensation collected in well 88 will in turn drain out through drain orifice 90 which may be connected to an existing floor drain or sump such as are commonly found in most basements. Because any drainage onto the floor can contribute to an unwanted increase in humidity or dampness, the air deflection sytem, air retainer, and base are constructed to provide a circuitous path for the drainage of condensation. The circuitous path helps to encourage reevaporation of the condensation for exit through the flue where it will not contribute to increased humidity or dampness.

While it will be apparent that the preferred embodiment of the invention is well calculated to fulfill the objects above stated, it will be appreciated that the invention is susceptible to modification, variation and change without departing from the proper scope or fair meaning of the invention.

What is claimed is:

1. A water preheating system for use with a laundry dryer having a vent for exhausting heated air therefrom and a hot water heater having an inlet pipe for coupling to a source of water to be heated comprising:
   - a tank having an underside;
   - a base for supporting said tank;
   - air intake port receptive of heated air from said dryer vent;
   - air retainer means for directing said heated air from said air intake port generally towards the underside of said tank, wherein said air retainer means and the underside of said tank define a heating chamber;
   - exhaust flue communicating with said heating chamber;
   - condensation collection means disposed on said base generally beneath the underside of said tank having drain orifice therein for collecting and removing condensation from said heating chamber;
   - water inlet means adapted to receive water from a supply main and communicating with said tank for filling said tank;
   - water outlet means adapted to be coupled to the inlet pipe of said hot water heater so as to supply preheated water to said hot water heater.

2. The apparatus of claim 1 wherein said air retainer means comprises dish means having a passageway therein and having axially presenting peripheral flange disposed next to the underside of said tank said apparatus further comprising conduit means communicating between said passageway and said air intake port.

3. The apparatus of claim 1 wherein said air retainer means is disposed generally between the underside of said tank and said condensation collection means and includes perforation means for discharging condensation from said heating chamber.

4. The apparatus of claim 2 wherein said conduit means includes upwardly presenting distal end portion and said dish means is carried on said distal end portion.

5. The apparatus of claim 2 further comprising adjustment means for axially positioning said peripheral flange into abutting relationship with the underside of said tank.

6. The apparatus of claim 2 further comprising air deflection means disposed within said heating chamber for directing the flow of heated air radially along the underside of said tank within said chamber.

7. The apparatus of claim 2 further comprising baffle means carried on said peripheral flange and disposed between said dish means and the underside of said tank, said baffle means being so constructed and arranged to direct heated air radially inwardly along the underside of said tank, said baffle means further includes an orifice for relieving back pressures within said heating chamber.

8. The apparatus of claim 2 further comprising baffle means disposed between said dish means and the underside of said tank defining a first space generally adjacent said dish means and a second space generally adjacent the underside of said tank, said baffle having an outer periphery defining a first opening for communicating heated air between said first and second spaces and having a means for reducing air pressure within said second space so as to draw heated air from said first space into said second space.

9. The apparatus of claim 8 wherein said means for reducing air pressures within said second space comprises restricted orifice means communicating between said first and second spaces.

10. The apparatus of claim 9 wherein said restricted orifice means is disposed in axial alignment with said exhaust flue.

11. The apparatus of claim 2 wherein said passageway is disposed in axial alignment with said exhaust flue.

12. The apparatus of claim 10 wherein said restricted orifice means is disposed in axial alignment with said passageway.

13. The apparatus of claim 1 wherein said condensation collection means comprises annular well integrally formed in said base.

* * * * *

UNITED STATES PATENT AND TRADEMARK OFFICE

CERTIFICATE OF CORRECTION

PATENT NO. : 4,412,391

DATED : November 1, 1983

INVENTOR(S) : BOLOGNINO, JOHN V.

It is certified that error appears in the above-identified patent and that said Letters Patent is hereby corrected as shown below:

| | | |
|---|---|---|
| Column 2, | line 46 | "theinvention" should be-- the invention-- |
| Column 5, | lines 44-45 | "under-sirable" should be --undesireable-- |
| Column 7 | line 11 | "pressure" should be --pressures-- |

Signed and Sealed this

*Third* Day of *January 1984*

[SEAL]

*Attest:*

GERALD J. MOSSINGHOFF

*Attesting Officer*

*Commissioner of Patents and Trademarks*